US010353327B2

(12) United States Patent
Yasui et al.

(10) Patent No.: US 10,353,327 B2
(45) Date of Patent: Jul. 16, 2019

(54) FIXING DEVICE FOR FIXING AN IMAGE ON A RECORDING MATERIAL AND HAVING A NIP PLATE WITH A PROJECTION THAT PROJECTS TOWARDS A ROLLER

(71) Applicant: CANON KABUSHIKI KAISHA, Tokyo (JP)

(72) Inventors: Koji Yasui, Yokohama (JP); Takaaki Tsuruya, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/969,906

(22) Filed: May 3, 2018

(65) Prior Publication Data

US 2018/0246447 A1 Aug. 30, 2018

Related U.S. Application Data

(62) Division of application No. 15/412,394, filed on Jan. 23, 2017, now Pat. No. 9,977,381.

(30) Foreign Application Priority Data

Jan. 26, 2016 (JP) ..... 2016-012279

(51) Int. Cl.
*G03G 15/20* (2006.01)

(52) U.S. Cl.
CPC . *G03G 15/2053* (2013.01); *G03G 2215/2035* (2013.01)

(58) Field of Classification Search
CPC ..... G03G 15/2053
USPC ..... 399/329
See application file for complete search history.

(56) References Cited

U.S. PATENT DOCUMENTS

2011/0150543 A1* 6/2011 Fujiwara ..... G03G 15/2053 399/329
2011/0158716 A1 6/2011 Fujiwara et al.
2011/0305473 A1 12/2011 Tamaki
2014/0294465 A1 10/2014 Hazeyama et al.
(Continued)

FOREIGN PATENT DOCUMENTS

JP 2006-078578 A 3/2006
JP 2014-066851 A 4/2014
JP 2014-199304 A 10/2014
(Continued)

*Primary Examiner* — Quana Grainger
(74) *Attorney, Agent, or Firm* — Venable LLP

(57) ABSTRACT

A fixing device fixes an image onto a recording material. The recording material is fed through and heated in a nip to fix the image. A nip plate is provided with a projection in a region downstream of the nip with respect to a feeding direction of the recording material, the projection projecting toward a roller and extending in a longitudinal direction of a cylindrical belt. The nip plate has a recess on a side opposite from an outside provided with the projection at a position corresponding to that of the projection with respect to the feeding direction, the recess extending in the longitudinal direction of the cylindrical belt. At least a part of one of the two end portions of a supporting member overlaps the recess of the nip plate with respect to the feeding direction of the recording material and a longitudinal direction of the cylindrical belt.

15 Claims, 6 Drawing Sheets

(56) References Cited

U.S. PATENT DOCUMENTS

2015/0093168 A1 4/2015 Hiramatsu

FOREIGN PATENT DOCUMENTS

JP 2015-069002 A 4/2015
JP 2015-111243 A 6/2015

* cited by examiner

FIXING DEVICE FOR FIXING AN IMAGE ON A RECORDING MATERIAL AND HAVING A NIP PLATE WITH A PROJECTION THAT PROJECTS TOWARDS A ROLLER

This application is a divisional application of U.S. patent application Ser. No. 15/412,394, filed Jan. 23, 2017, which claims the benefit of Japanese Patent Application No. 2016-012279, filed Jan. 26, 2016, both of which are hereby incorporated by reference herein in their entireties.

FIELD OF THE INVENTION AND RELATED ART

The present invention relates to a fixing device that is mountable in an electrophotographic image forming apparatus, such as a copying machine, a printing machine, a facsimile machine, etc. Further, the present invention relates to a fixing device mountable in an electrophotographic multifunction machine that is capable of functioning as two or more of the preceding examples of image forming apparatuses.

In an electrophotographic image forming apparatus, a developer image (toner image) formed on a sheet of recording medium is thermally fixed by a fixing device. An example of fixing device that is employed by an electrophotographic image forming apparatus of the so-called heating belt type, which is structured so that the belt for heating a developer image (toner image) is heated by such a heat source as a halogen lamp.

More specifically, a fixing device of the heating belt type has a cylindrical fixation belt (hereafter referred to simply as "belt"), a heat generating member disposed on the inward side of the loop (belt loop) that the belt forms, a nip formation plate that is to be heated by the heat generating member, and a stay that supports the nip formation plate. The fixing device also has also a pressure roller that forms a nip (fixation nip) between itself and the nip formation plate, with the placement of the belt between itself and the nip formation plate. In an image forming operation, a sheet of recording medium on which a developer image is formed is introduced into the nip of the fixing device, and is then conveyed through the nip while remaining pinched between the belt and the pressure roller. Thus, the developer image on the sheet of recording medium is fixed to the sheet by the combination of the heat transmitted to the sheet and the developer image thereon from the heat generating member through the belt, and the pressure applied by the pressure roller.

In an image forming operation by a color image forming apparatus, two or more monochromatic developer images (toner images) that are different in color have to be fixed. Therefore, a fixing device to be employed by a color image forming apparatus has to be superior in fixing performance than the one to be employed by a monochromatic image forming apparatus. Further, in recent years, an image forming apparatus has come to be required to be higher in image quality, and, in particular, in glossiness. Thus, a fixing device has been desired to be higher in the level of glossiness with which it fixes a developer image. As one of the means for improving a fixing device in fixing performance, in particular, in the level of glossiness with which the fixing device fixes a developer image, the following method, described in Japanese Laid-Open Patent Application No. 2006-78578, has been known. According to this patent application, the fixing device is structured so that the peak (i.e., the point with maximum pressure) of the pressure distribution of the nip of the fixing device for fixing a developer image is in the downstream portion of the nip in terms of the recording medium conveyance direction of the nip, which is parallel to the shorter edges of the nip.

As another means for satisfying the above-described desire, it is possible to structure a fixing device as disclosed in Japanese Laid-open Patent Application No. 2014-66851. According to this patent application, which also describes means for improving a fixing device in its performance in terms of color image fixation and the glossiness level at which it fixes a developer image, the downstream end portion of the nip formation plate of the fixing device is provided with a long and narrow protrusive portion that protrudes toward the recording medium passage.

In such a fixing device, however, there is a substantial amount of pressure between the nip formation plate and the pressure roller. This pressure is likely to be concentrated to the portion of the nip that corresponds in position to the above-described protrusive portion. Therefore, it is possible that the protrusive portion will be deformed by the concentrated pressure. The deformation of the protrusive portion leads to the positional deviation of the pressure peak within the nip in terms of the direction parallel to the widthwise direction of the nip (recording medium conveyance direction), and/or a reduction in the amount of peak pressure. Therefore, it is detrimental to the effort to improve a fixing device in fixing performance, in particular, in terms of glossiness. One of the possible solutions to this problem is to increase in thickness the nip formation plate, which is formed of a metallic plate, in order to prevent the deformation of the above-described protrusive portion. Increasing the nip formation plate in thickness, however, leads to the increase in the thermal capacity of the nip formation plate, which results in the increase in the so-called First Print Out Time (FPOT).

SUMMARY OF THE INVENTION

According to one aspect, the present invention provides a fixing device for fixing an image on a recording material, the fixing device comprising a cylindrical belt, a nip plate contacting an inner surface of the cylindrical belt, a supporting member having a U-shaped cross section and provided in a hollow portion of the cylindrical belt, the supporting member having two end portions defining an opening of a U-shape thereof and supporting the nip plate, a heater provided in a region enclosed by the supporting member and the nip plate and configured to radiate radiant light to the nip plate to heat the nip plate and a roller cooperative with the nip plate to form a nip between the belt and an outer peripheral surface of the roller, wherein the recording material carrying the image is fed through and heated in the nip to fix the image on the recording material, wherein the nip plate is provided with a projection in a region downstream of the nip with respect to a feeding direction of the recording material, the projection projecting toward the roller and extending in a longitudinal direction of the cylindrical belt, and wherein at least a part of one of the two end portions of the supporting member overlaps the projection of the nip plate with respect to the feeding direction of the recording material and the longitudinal direction of the cylindrical belt to support the projection.

Further features of the present invention will become apparent from the following description of exemplary embodiments, with reference to the attached drawings.

Figure 3:
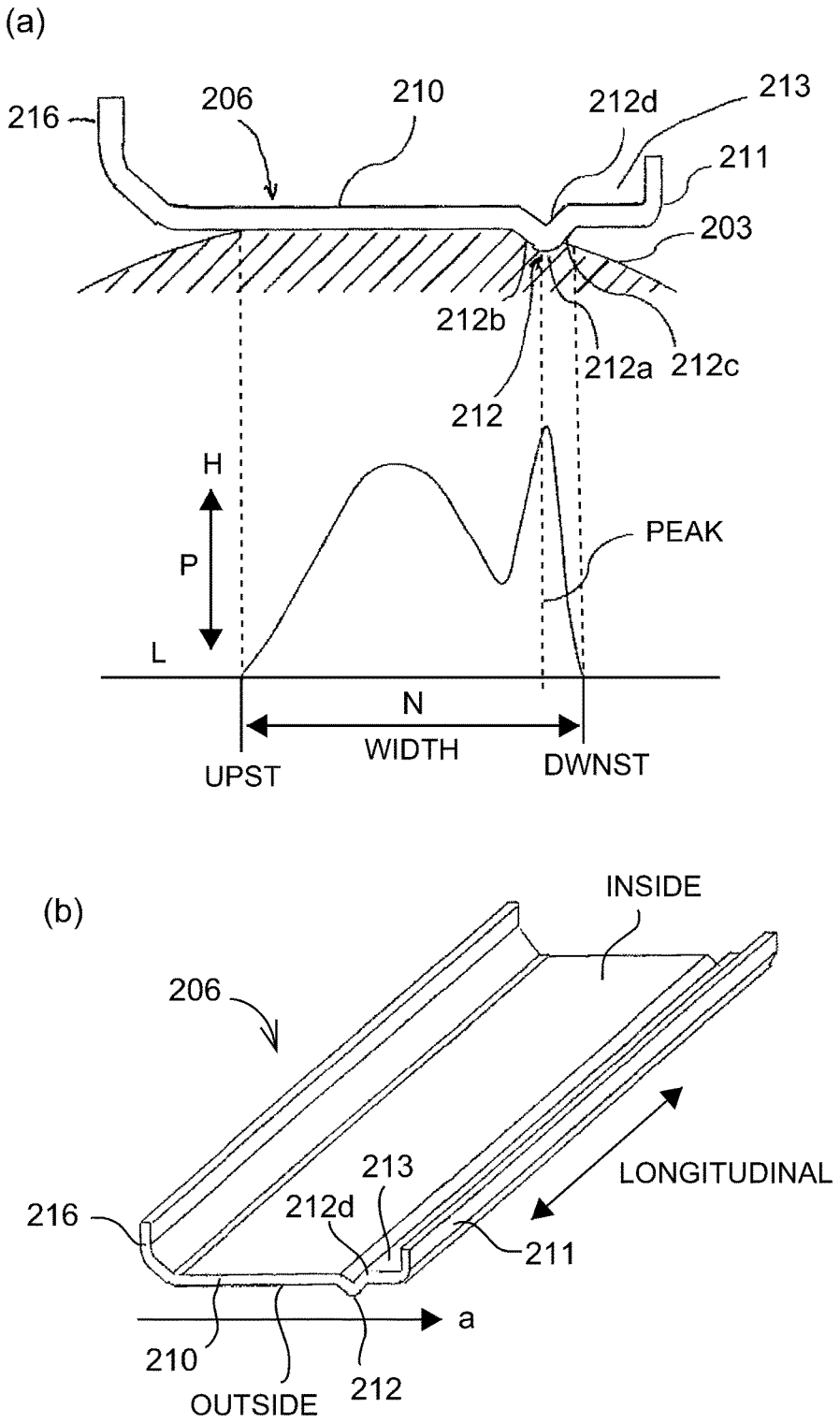

Part (a) of FIG. 3 is a combination of a sectional view of a nip formation plate, and a graph that shows a pressure distribution in a fixation nip, and part (b) of FIG. 3 is a perspective view of the nip formation plate.

Figure 1:
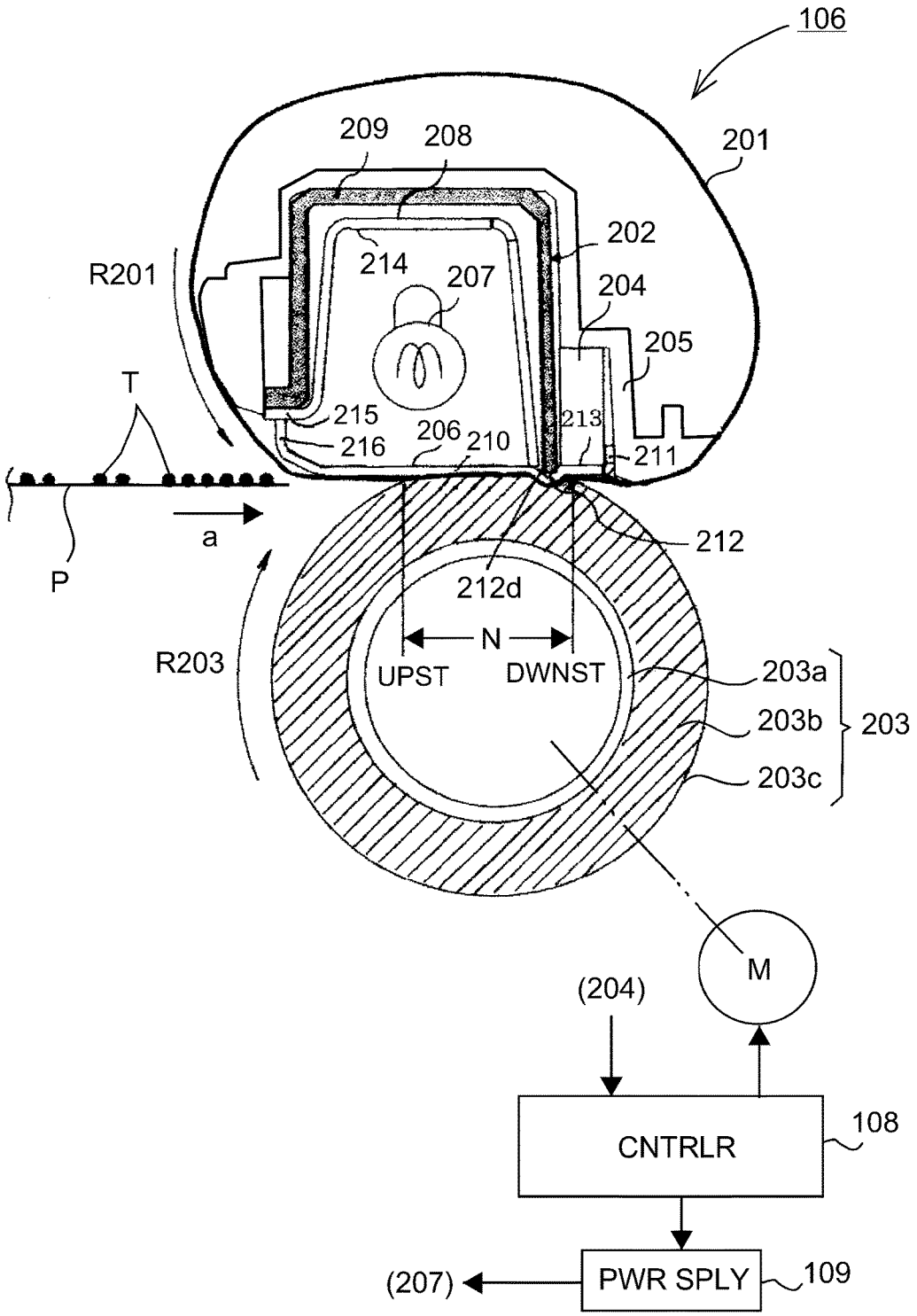
FIG. 1 is a combination of an enlarged cross-sectional view of an essential portion of a fixing device in one of the preferred embodiments of the present invention, and a block diagram of a control system of the fixing device.
Figure 4:
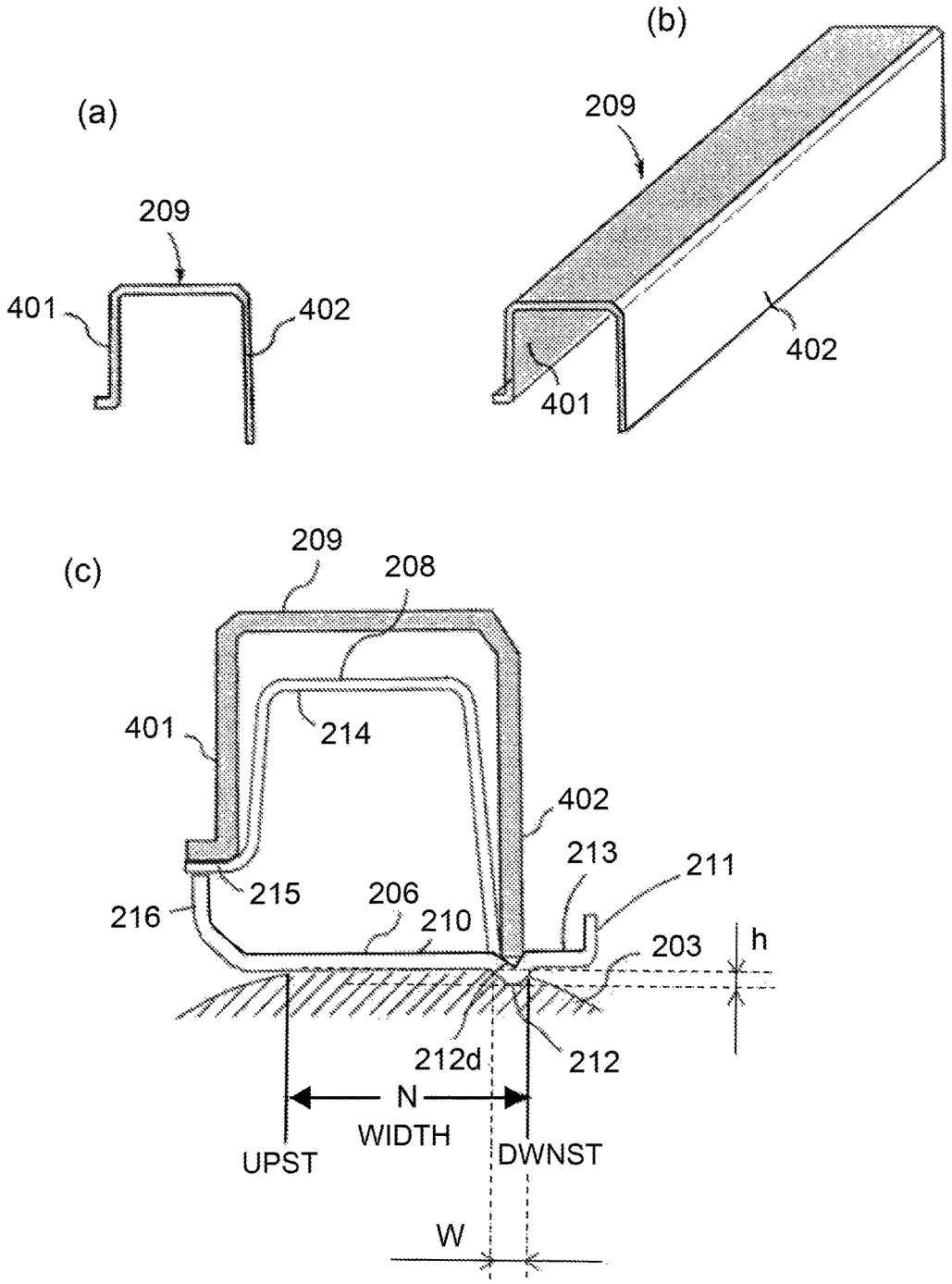

Part (a) of FIG. 4 is a sectional view of a stay, part (b) of FIG. 4 is a perspective view of the stay, and part (c) of FIG. 4 is a sectional view of the nip forming portion of the fixing device shown in FIG. 1.

Figure 5:
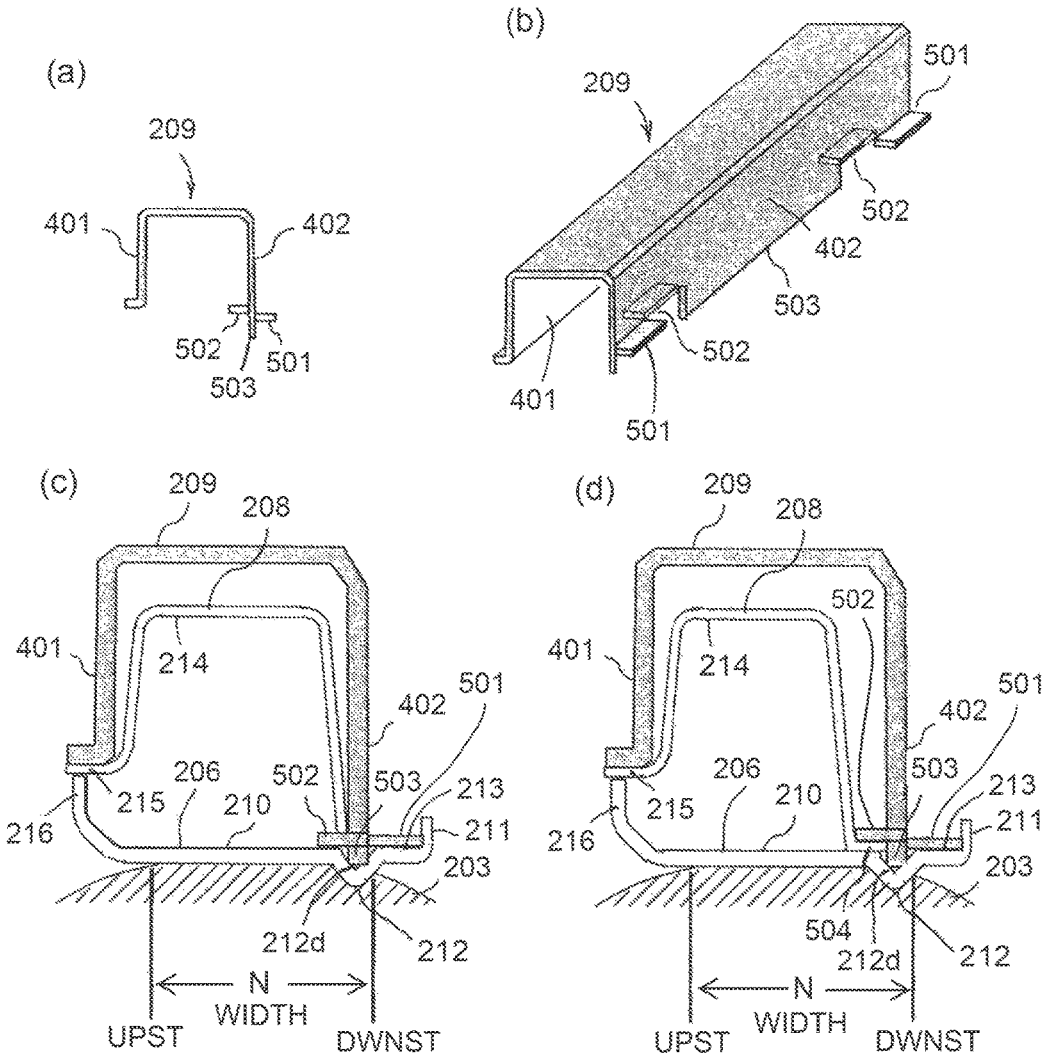

Part (a) of FIG. 5 is a sectional view of another example of a stay, which also is in accordance with the present invention, part (b) of FIG. 5 is a perspective view of the stay shown in part (a) of FIG. 5, and parts (c) and (d) of FIG. 5 are sectional views of the nip forming portions, one for one, that comprise the stay shown in part (a) of FIG. 5, but are different in configuration.

Figure 6:
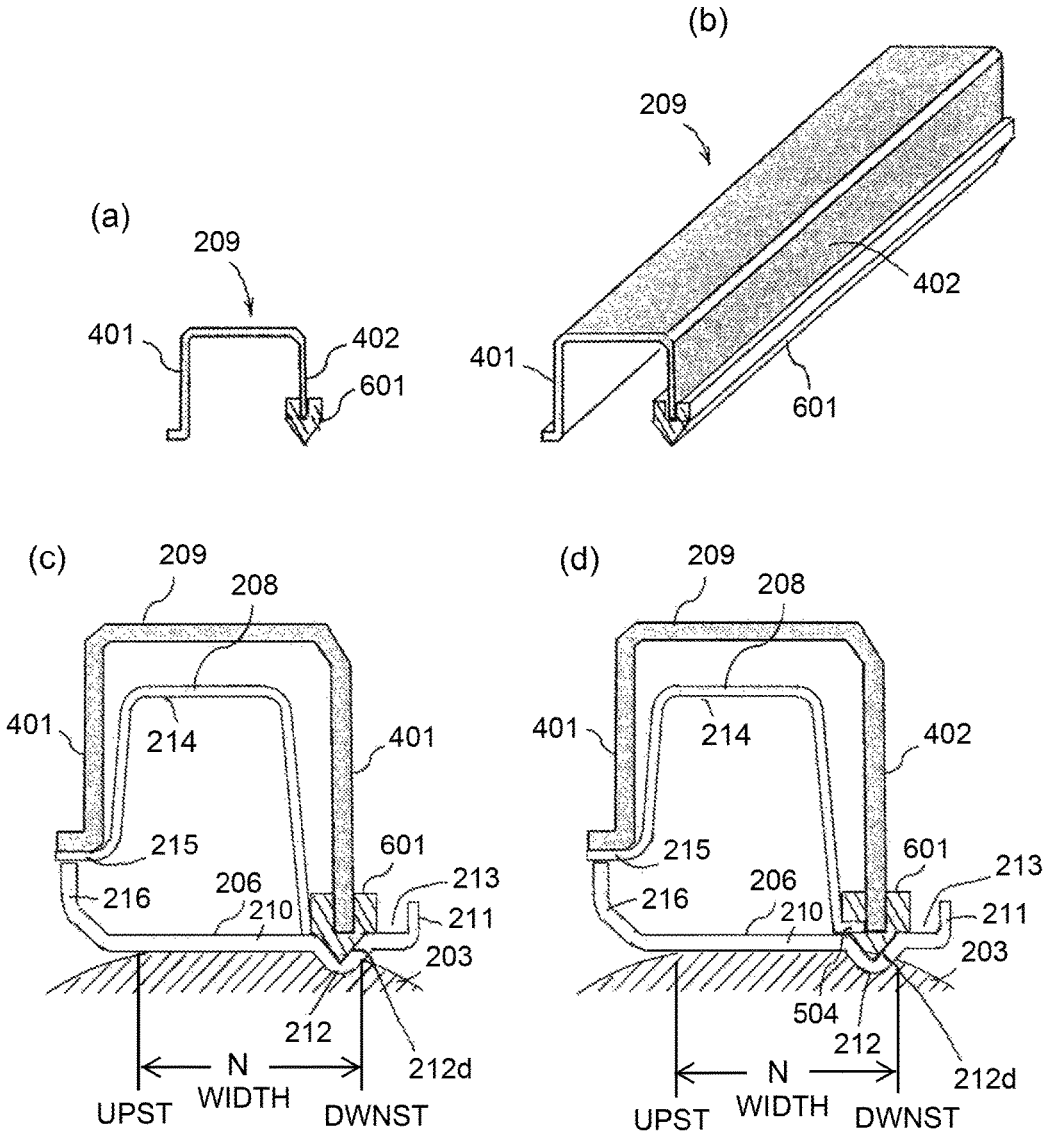

Part (a) of FIG. 6 is a sectional view of yet another example of a stay, which also is in accordance with the present invention, part (b) of FIG. 6 is a perspective view of the stay shown in part (a) of FIG. 6, and parts (c) and (d) are sectional views of nip forming portions, one for one, that comprise the nip formation plate shown in part (a) of FIG. 6, but are different in configuration.

DESCRIPTION OF THE EMBODIMENTS

First Embodiment

Image Forming Apparatus

Figure 2:
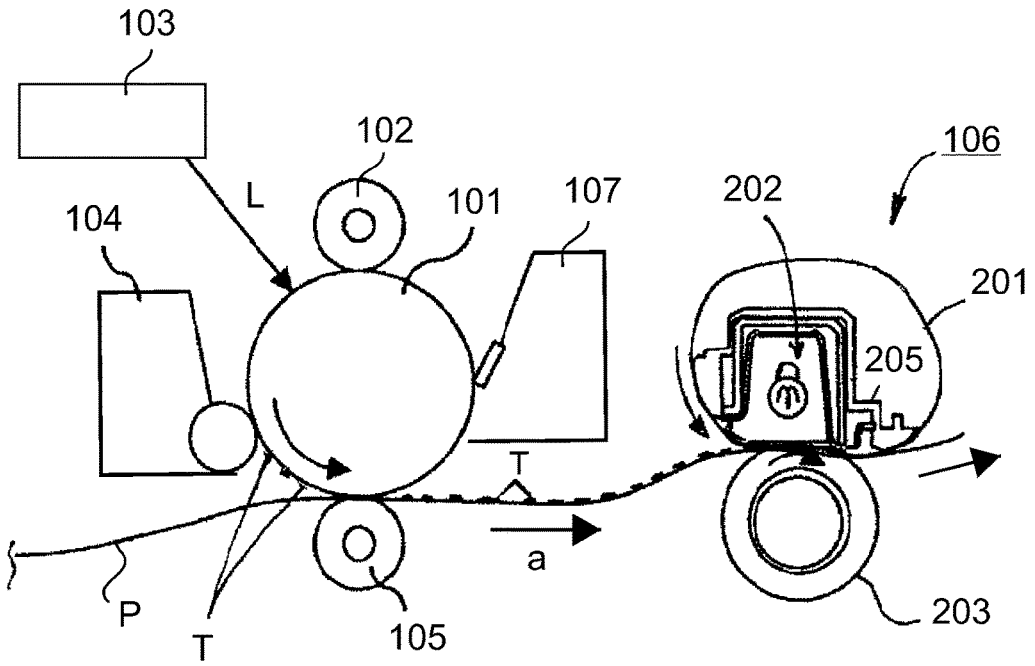
FIG. 2 is a schematic cross-sectional view of an essential portion of an image forming apparatus in the preferred embodiment.

To begin with, an example of an image forming apparatus with which the present invention is compatible is described with reference to FIG. 2, which is a schematic sectional view of the essential portion of the image forming apparatus in this embodiment. This image forming apparatus is a laser beam printer that uses an electrophotographic process of the so-called transfer type. The image forming apparatus has a fixing device 106 that has a heating belt 201 and a halogen lamp (halogen heater) 202.

This image forming apparatus has an electrophotographic photosensitive member 101 (hereafter referred to simply as "drum") that is rotational. The image forming apparatus also has a charge roller 102, an exposing device 103 (laser scanner), a developing device 104, and a transfer roller 105 that are disposed in the adjacencies of the peripheral surface of the drum 101, in the listed order. The drum 101 is rotationally driven at a preset peripheral velocity. As the drum 101 is rotationally driven, its peripheral surface is uniformly charged to a preset polarity and a potential level by the charge roller 102. Then, a beam L of laser light is projected by the exposing device 103 upon the uniformly charged portion of the peripheral surface of the drum 101, while being modulated according to information of an image to be formed. Consequently, an electrostatic latent image of the image to be formed is effected on the peripheral surface of the drum 101.

The electrostatic latent image is developed by the developing device 104 into a toner image T (developer image). Then, the toner image T is conveyed to a transfer nip, which is the area of contact between the drum 101 and the transfer roller 105, by the subsequent rotation of the drum 101. Meanwhile, a sheet P of recording medium conveyed to the transfer nip from a recording medium feeding-conveying portion (unshown) is introduced into the transfer nip with a preset control timing, and is conveyed through the transfer nip. While the sheet P is conveyed through the transfer nip, the toner image T on the drum 101 is transferred onto the sheet P as if it is peeled away from the peripheral surface of the drum 101.

As the sheet P of recording medium is conveyed out of the transfer nip, the sheet P is separated from the peripheral surface of the drum 101 as if it is peeled away from the drum 101. Then, the sheet P is conveyed to the fixing device 106, and is then conveyed through the fixing device 106. While the sheet P is conveyed through the fixing device 106, the fixing device 106 applies heat and pressure to the sheet P and the developer image thereon, to fix the toner image T to the sheet P. After the fixation of the toner image T to the sheet P, the sheet P is discharged from the main assembly of the image forming apparatus. Even after the separation of the sheet P from the peripheral surface of the drum 101, a certain amount of the toner from the toner image T remains adhered to the peripheral surface of the drum 101. This residual toner is removed by a cleaning device 107 so that the drum 101 can be repeatedly used for image formation.

Fixing Device

FIG. 1 is an enlarged cross-sectional view of the essential portion of the fixing device 106 (at a vertical plane that is perpendicular to a rotational axis of a pressure roller 203). This fixing device 106 is such a fixing device (image heating device) that employs a heating belt 201 and a halogen lamp 207 as a heat generating member. In the following description of the fixing device 106, the upstream and downstream directions are in terms of the recording medium conveyance direction a.

The fixing device 106 has a cylindrical fixation belt 201 (which hereafter will be referred to simply as "belt"), and a heating unit 202 disposed on the inward side of the loop (belt loop) that the belt 201 forms, to heat the belt 201.

The heating unit 202 is provided with a nip formation plate 206, a halogen lamp 207 as a heater, a reflecting member 208, and a stay 209 (rigid supporting member). Further, the heating unit 202 has a guiding member 205 that is disposed in a manner to surround the heating unit 202 except for the nip formation plate 206. In addition, the heating unit 202 has a pressure roller 203, as a rotationally drivable member, that forms a nip N (fixation nip) between itself and the nip formation plate 206 of the heating unit 202, with the presence of the belt 201 between itself and the nip formation plate 206. Here, the nip N is the area of contact between the belt 201 and the pressure roller 203.

Each of the above-mentioned structural components of the fixing device 106 is wide and long enough to satisfactorily deal with the widest sheet P of recording medium (in terms of direction perpendicular to recording medium conveyance direction a). The belt 201 is a thin, heat-resistant, flexible, and thermally conductive member. If the belt 201 is left in its natural state, it becomes roughly cylindrical because of its resiliency. The belt 201 may be a monolayer belt or a multilayer belt, and is formed of a metallic or a resinous substance. The belt 201 is loosely fitted around a combination of the heating unit 202 and the guiding member 205. The assembled combination of the belt 201, the heating unit 202, and the guiding member 205 is the belt assembly.

The nip formation plate 206 is a long and narrow component, and is formed of a metallic substance. The outward surface of the nip formation plate 206, that is, the surface that faces outward of the belt loop after the assembly of the fixing device 106, is where the inward surface of the belt 201 slides while remaining airtightly in contact with the outward surface. The inward side of the nip formation plate 206 is heated by the radiant heat that it receives from the halogen lamp 207. The nip formation plate 206 is formed of a piece of aluminum plate, or the like, that is greater in thermal conductivity than the stay 209. The nip formation plate 206 is formed by pressing, or a like method.

The halogen lamp 207 is a long and narrow heater (radiant heat source) that is disposed so that its lengthwise direction is parallel to the lengthwise direction of the nip formation plate 206. The halogen lamp 207 is disposed on the inward side of the nip formation plate 206, with the presence of preset distances from the nip formation plate 206 and the reflecting member 208. The halogen lamp 207 outputs radiant heat to heat the nip formation plate 206 from the inward side of the nip formation plate 206.

The reflecting member 208 is disposed in a manner to be between the stay 209 and a halogen lamp 207, and also between the stay 209 and the nip formation plate 206. The inward surface of the reflecting member 208 is the radiant heat reflecting portion 214. The reflecting member 208 is a long and narrow component, and is disposed so that its lengthwise direction becomes parallel to the lengthwise direction of the halogen lamp 207. The reflecting member 208 is formed of a piece of aluminum plate that can highly effectively reflect infrared radiation and far-infrared radiation. The reflecting member 208 is formed by pressing so that it becomes roughly U-shaped in cross section. The reflecting member 208 has a flange portion 215 that is the upstream end portion of the reflective portion 214. The flange portion 215 extends away from the halogen lamp 207.

The radiant heat from the halogen lamp 207 is concentrated to the inward side of the nip formation plate 206 by this reflecting member 208. Thus, the radiant heat from the halogen lamp 207 can be efficiently used. Therefore, it is possible to quickly heat the nip formation plate 206.

The stay 209 is a rigid component, and is long and narrow. The stay 209 is disposed so that its lengthwise direction becomes parallel to the lengthwise direction of the nip formation plate 206. The stay 209 is formed of a piece of metallic plate, such as a piece of steel plate, by pressing, and is roughly U-shaped in cross section. More specifically, the stay 209 is shaped so that it conforms in shape to the external shape of the reflecting member 208. The stay 209, which is U-shaped in cross section with reference to a plane perpendicular to the widthwise direction of the belt 201, is disposed so that its lengthwise end portions, which are also U-shaped in cross section, support the nip formation plate 206.

The guiding member 205 also is a long and narrow component, and is formed of a heat resistant resin. The guiding member 205 is formed by molding, and is disposed so that its lengthwise direction becomes parallel to the lengthwise direction of the heating unit 202, and also, so that it surrounds the heating unit 202 except for the nip formation plate 206 of the heating unit 202. Further, the guiding member 205 functions as a rotation guide for the belt 201.

The pressure roller 203 is an elastic roller, and has a metallic core 203*a*, and a heat resistant elastic layer 203*b* that is coaxially formed on the peripheral surface of the metallic core 203*a*. The pressure roller 203 may be provided with a release layer 203*c* that is to be formed on the outward surface of the elastic layer 203*b*. The pressure roller 203 is rotatably supported by a pair of lateral plates, one for one, of a fixing device casing (unshown). That is, the lengthwise end portions of the metallic core 203*a* are rotatably supported by a pair of bearings attached to the lateral plates, one for one.

The pressure roller 203 and the aforementioned belt assembly, or the combination of the belt 201, the heating unit 202, and the guiding member 205, are disposed so that the pressure roller 203 becomes roughly parallel to the belt assembly, the nip formation plate 206 is between the mutually opposing lateral plates of the fixing device casing, and the pressure roller 203 opposes the nip formation plate 206.

Further, the lengthwise ends of the stay 209 are kept under a preset amount of pressure generated by a pair of pressure application mechanisms (unshown), in a direction to press the nip formation plate 206 against the pressure roller 203, with the presence of the belt 201 between the nip formation plate 206 and the pressure roller 203, against the resiliency of the elastic layer 203*b* of the pressure roller 203. Thus, the nip N, which has a preset width (dimension in terms of recording medium conveyance direction a), is formed between the belt 201 and pressure roller 203.

By the way, the fixing device 106 may be structured so that the above-described nip N having the preset amount of width is formed by pressing the pressure roller 203 against the nip formation plate 206, with the presence of the belt 201 between the pressure roller 203 and the nip formation plate 206, against the resiliency of the elastic layer 203*b*, by the pressure application mechanisms. Further, the fixing device 106 may be structured so that the above-described nip N having the preset amount of width is formed by causing the nip formation plate 206 and the pressure roller 203 to press against each other by the pressure application mechanisms. That is, all that is necessary is that the fixing device 106 is structured so that the pressure generation mechanisms apply pressure to the stay 209 or the pressure roller 203, or both the stay 209 and the pressure roller 203, to cause the nip formation plate 206 and the pressure roller 203 to press against each other to form the nip N between themselves against the resiliency of the pressure roller 203.

Further, the fixing device 106 is provided with a driving gear (unshown) that is coaxially attached to one of the lengthwise ends of the metallic core 203*a* of the pressure roller 203, and to which the driving force from a motor M (driving force source), which is under the control of a controlling portion 108 (control circuit), is transmitted through a driving force transmission mechanism (unshown). Thus, the pressure roller 203 is rotationally driven at a preset peripheral velocity in the clockwise direction indicated by an arrow mark 8203 in FIG. 1.

As the pressure roller 203 is rotated, friction is generated between the peripheral surface of the pressure roller 203 and the outward surface of the belt 201. The combination of this friction and the rotational movement of the peripheral surface of the pressure roller 203 applies a rotational force (torque) that causes the belt 201 to rotationally move. Thus, the belt 201 rotationally moves in the counterclockwise direction as indicated by an arrow mark 8201 in FIG. 1, with its inward surface (belt contacting surface) remaining in contact with the outward surface of the nip formation plate 206, in the nip N, at a peripheral velocity that is roughly equal to the peripheral velocity of the pressure roller 203.

By the way, as the belt 201 is rotated, it tends to deviate in position (snake) in the direction parallel to a widthwise direction of the belt 201. This positional deviation of the belt 201 is regulated by a pair of regulating members (unshown end members) that are disposed at the lengthwise ends of the combination of the heating unit 202 and the guiding member 205. Thus, as the belt 201 deviates, it is caught by the regulating members, by one of the edges of the belt 201, being thereby prevented from deviating further.

The halogen lamp 207 is supplied with electrical power by a power supplying portion 109, which is under the control of the controlling portion 108, through the metallic end portions of the halogen lamp 207, and the sockets (unshown) that are in connection with the metallic portions (unshown) of the lengthwise ends of the lamp 207. As the halogen lamp 207 receives the electrical power, its heat generating portion generates radiant heat, which directly hits the inward side of the nip formation plate 206, or is reflected by the reflective portion 214 of the reflecting member 208, being thereby focused on the nip formation plate 206.

Thus, the portion of the nip formation plate 206, which corresponds in position to the heat generating portion of the halogen lamp 207, is quickly heated, whereby the belt 201 is quickly heated as the belt 201 is rotated, sliding on the outward surface of the nip formation plate 206, while remaining in contact with the outward surface of the nip formation plate 206.

The heating unit 202 or the guiding member 205 is equipped with a temperature detecting member 204 (temperature sensor) for detecting the temperature of the nip formation plate 206. The information regarding the temperature of the nip formation plate 206 detected by the temperature detecting member 204 is fed back to the controlling portion 108.

The controlling portion 108 controls the temperature of the nip formation plate 206 by controlling the electrical power to be supplied to the halogen lamp 207 from the power supplying portion 109, based on the information sent from the temperature detecting member 204 regarding the temperature of the nip formation plate 206 detected by the temperature detecting member 204, so that the temperature of the nip formation plate 206 is increased to, and remains at, the preset level. The temperature detecting member 204 may be any of known temperature sensors, such as, for example, a thermistor, thermostat, or the like. By the way, the fixing device 106 is provided with one temperature detecting member 204. The fixing device 106 may, however, be provided with two or more temperature detecting members 204 that are aligned in the lengthwise direction of the nip formation plate 206.

While the pressure roller 203 is rotationally driven, the halogen lamp 207 is being supplied with the electrical power, and the temperature of the nip formation plate 206 is kept at the present level, a sheet P of recording medium, on which an unfixed toner image T is present, is introduced into the nip N, and is then conveyed through the nip N while remaining pinched between the belt 201 and the pressure roller 203. Thus, the toner image T and the sheet P are subjected to the heat from the belt 201 and the nip pressure. Consequently, the toner image T is fixed, as a permanent image, to the sheet P. After being conveyed through the nip N while remaining pinched between the belt 201 and the pressure roller 203, the sheet P is separated from the surface of the belt 201 by the curvature of the belt 201 at the recording medium exit portion of the nip N, and is then discharged from the fixing device 106 to be conveyed further.

Structural Configuration for Preventing Protrusive Portion of Nip Formation Plate from being Deformed In order to make the above-described fixing device 106 greater in fixing performance, and, in particular, in the glossiness of the fixed image, the downstream end portion (in terms of recording medium conveyance direction a) of the nip formation plate 206 of the above-described fixing device 106, which will be in the nip N after the fixing device 106 is assembled, is provided with a protrusive portion 212, which is protrusive toward the recording medium passage of the fixing device 106. Moreover, the fixing device 106 is structured to prevent the deformation of the protrusive portion 212. The protrusive portion 212 is a part of the nip formation plate 206 that will be in the downstream area of the nip N in terms of the recording medium conveyance direction a. The protrusive portion also is long and narrow, and is shaped so that its lengthwise direction becomes parallel to the widthwise direction of the belt 201. The protrusive portion 212 is protrusive toward the pressure roller 203. Next, the protrusive portion 212 is described in detail.

Part (a) of FIG. 3 is a combination of an enlarged cross-sectional view of the nip formation plate 206 and a graph that shows the pressure distribution of the nip N in terms of the recording medium conveyance direction a, and part (b) of FIG. 3 is a perspective view of the nip formation plate 206. The nip formation plate 206 has a flat portion 210 (flat plate portion), and a downstream vertical portion 211 and an upstream vertical portion 216 that are formed by perpendicularly bending the downstream and upstream end portions, respectively, of the nip formation plate 206 in the opposite direction from the pressure roller 203 (inward side of nip formation plate 206). The lengthwise direction of the flat portion 210, the downstream vertical portion 211, and the upstream vertical portion 216 are parallel to the lengthwise direction of the nip formation plate 206. The protrusive portion 212 is the portion of the nip formation plate 206 that is protrusive toward the pressure roller 203 relative to the flat portion 210.

Further, the portion of the nip formation plate 206 that is between the flat portion 210 and the downstream vertical portion 211 has the protrusive portion 212 that is protrusive toward the pressure roller 203 (outward side of nip formation plate 206).

That is, the nip formation plate 206 has the flat portion 210 (flat plate portion), and the protrusive portion 212 that will be in the downstream end portion of the nip N, in terms of the recording medium conveyance direction a, and is protrusive toward the pressure roller 203 relative to the flat portion 210, after the assembly of the fixing device 106. The lengthwise direction of the protrusive portion 212 is parallel to the lengthwise direction of the nip formation plate 206. The protrusive portion 212 is formed together with the flat portion 210, the downstream vertical portion 211, and the upstream vertical portion 216 of the nip formation plate 206 by pressing a piece of metallic plate as the material for the nip formation plate 206.

Referring to the cross-sectional view of the nip forming portion, the protrusive portion 212 has a tip portion 212*a* that has such a curvature that is equal to the curvature of a circle, the radius of which is R, and a pair of slanted portions 212*b* and 212*c*, that is, the upstream and downstream slanted portions, which are symmetrically positioned relative to the tip portion 212*a*. Since the protrusive portion 212 is formed as a piece of metallic plate that is pressed to form the nip formation plate 206, the inward side of the protrusive portion 212 has a recess 212*d*.

The outward surface of the flat portion 210 contacts the inward surface of the belt 201, and sandwiches the belt 201 between itself and the pressure roller 203. Further, the flat portion 210 transfers the radiant heat from the halogen lamp 207 to the toner on the sheet P of recording medium through the belt 201.

The downstream vertical portion 211 is the portion of the nip formation plate 206 that extends downstream from the downstream end (edge) of the protrusive portion 212 by a preset length and vertically extends away from the pressure roller 203 by a preset length, so that a recess 213 is formed on the opposite side of the nip formation plate 206 from the pressure roller 203. Further, the nip formation plate 206 is formed so that the recess 213 is roughly the same in size as the bottom portion of the temperature detecting member 204 to accommodate the temperature detecting member 204, which is disposed in the top portion of the recess 213.

Referring to part (a) of FIG. 3, which shows the pressure distribution in the nip N, the protrusive portion 212 is formed so that the contact pressure between the nip formation plate 206 and the pressure roller 203 becomes greatest in the downstream portion of the nip N in terms of the widthwise direction of the nip N. Thus, it becomes possible to apply high pressure to the toner while the toner remains fully melted after being conveyed through almost the entirety of the nip N along with the sheet P of recording medium, and, therefore, it becomes possible to make the toner particles in the toner image T on the sheet P to combine not only among themselves, but also, with the sheet P. Therefore, it is possible to provide a fixing device that is significantly higher in fixing performance, and, in particular, in glossiness level, than any conventional fixing device.

Part (a) of FIG. 4 is a cross-sectional view of the stay 209, part (b) of FIG. 4 is a perspective view of the stay 209, and part (c) of FIG. 4 is a cross-sectional view of the nip forming portion. The stay 209, which is a rigid component, sandwiches the nip formation plate 206 between itself and the pressure roller 203 from the opposite side of the nip formation plate 206 from the pressure roller 203, in a manner to support the nip formation plate 206 by the upstream and downstream edges of the flat portion 210. The stay 209 is such a member of the fixing device 106 that catches the force applied to the nip formation plate 206 by the pressure roller 203 when the force is applied.

With reference to the cross-sectional view of the nip forming portion, the stay 209 is bent so that the first supporting portion 401, which is an upstream portion of the stay 209, overlaps with the flange portion 215 of the reflecting member 208, and also, with the upstream vertical portion 216 of the nip formation plate 206, which is under the flange portion 215. Further, the stay 209 is bent so that the second supporting portion 402, which is a part of the downstream portion of the stay 209, at least partially fits in the recess 212*d* (backside of protrusive portion 212) of the nip formation plate 206. That is, a part of the stay 209 backs up the protrusive portion 212 by being in contact with at least part of the recess 212*d* of the protrusive portion 212 (or a backside of the protrusive portion 212), from the opposite side of the nip formation plate 206 from the surface of the nip formation plate 206 on which the belt 201 slides.

That is, the fixing device 106 is structured so that the edge of at least one of the upstream and downstream portions of the stay 209, which is U-shaped in cross section, overlaps with the protrusive portion 212 of the nip formation plate 206, and supports the protrusive portion 212.

By the way, the desirable range for the amount h by which the protrusive portion 212 is made to protrude to provide the nip N with a pressure peak is 50 μm to 300 μm. As for the desirable range for the width w, in terms of the recording medium conveyance direction a, the width w is 200 μm to 300 μm. The width w of the protrusive portion 212 is the dimension of the portion of the nip formation plate 206 that is in the nip N and is protrusive toward the pressure roller 203 from the flat portion 210 that is in contact with the belt 201, in terms of the recording medium conveyance direction a.

(1) The structure of the stay 209 may be different from the above-described one. For example, the stay 209 may be structured as shown in parts (a) to (c) of FIG. 5. Part (a) of FIG. 5 is a cross-sectional view of a stay 209 that is different in structure from the above-described structure. Part (b) of FIG. 5 is a perspective view of the stay 209 shown in part (a) of FIG. 5, and part (c) of FIG. 5 is a cross-sectional view of the nip forming portion. Referring to the cross-sectional view of the stay 209, the second supporting portion 402 of the stay 209 has a horizontal outward portion 501, a horizontal inward portion 502, and a vertical portion 503.

The stay 209 is formed so that at least a part of the vertical portion 503 overlaps with the recess 212*d* (i.e., an inward side of protrusive portion 212 of the nip formation plate 206). Further, the stay 209 is formed so that the horizontal outward portion 501 and the horizontal inward portion 502 press on the adjacencies of the recess 213 and the flat portion 210, respectively, to keep the flat portion 210 of the nip formation plate 206 pressed toward the pressure roller 203.

(2) Further, the stay 209 formed as shown in parts (a) to (c) of FIG. 5 may be disposed as shown in part (d) of FIG. 5. That is, referring to the cross-sectional view of the reflecting member 208, the stay 209 may be disposed so that its horizontal inward portion 502 presses on at least a part of the flange portion 504 of the reflecting member 208.

(3) Further, the structure of the stay 209 may be as shown in parts (a) to (c) of FIG. 6. Part (a) of FIG. 6 is a cross-sectional view of the stay 209 that is different in structure from the above-described structures. Part (b) of FIG. 6 is a perspective view of the stay 209 shown in part (a) of FIG. 6, and part (c) of FIG. 6 is a cross-sectional view of the nip forming portion. Referring to the cross-sectional view of the stay 209, the bottom edge of the second supporting portion 402 of the stay 209 is fitted with a holding member 601 (spacer) that is shaped so that it fits at least partially in the recess 212, that is, the inward side of the protrusive portion 212, of the nip formation plate 206. The spacer 601 is desired to be formed of resin, because the spacer 601 functions as a thermally insulating member that makes it difficult for the heat from the nip formation plate 206, which is metallic, to escape into the stay 209.

(4) Further, the stay 209, structured as shown in parts (a) to (c) of FIG. 6, may be disposed as shown in part (d) of FIG. 6. That is, referring to the cross-sectional view of the reflecting member 208, the stay 209 may be disposed so that the holding portion 601 keeps the flange portion 504, which is the downstream edge portion of the reflecting portion 214, pressed upon the flat portion 210 by pressing at least a portion of the holding portion 601. By the way, the guiding member 205 may be made to double as the holding member 601.

According to the embodiment described above, the fixing device 106, the heat source of which is the halogen lamp 207, is structured so that the protrusive portion 212 is placed in the downstream portion of the nip N. Therefore, it is possible to effectively back up the protrusive portion 212 of the nip formation plate 206 by pressing the protrusive portion 212 from the back side the protrusive portion 212.

If the upstream edge portion of the stay 209 does not overlap with the portion of the nip formation plate 206, which is adjacent to the protrusive portion 212 of the nip formation plate 206, it is possible that, when contact pressure is present between the nip formation plate 206 and the pressure roller 203, the protrusive portion 212 of the nip formation plate 206 will collapse and/or the nip formation plate 206 will bend.

The above-described deformation can, however, be prevented by structuring the fixing device 106 so that the upstream edge portion of the stay 209 overlaps with the portion of the nip formation plate 206 that is adjacent to the protrusive portion 212 of the nip formation plate 206, as in this embodiment. That is, by structuring the fixing device 106 as described above, it is possible to keep the fixing device 106 in such a state that the pressure peak of the nip N is in the downstream portion of the nip N, and, therefore, it is possible to ensure that the fixing device 106 remains higher in fixing performance, and, in particular, in terms of image glossiness.

Even if the fixing device 106 is structured so that the downstream end of the nip formation plate 206 is provided with the protrusive portion 212, and, therefore, the pressure peak of the nip N is in the downstream end of the nip N, it is possible to make it unlikely for the protrusive portion 212 of the nip formation plate 206 to deform even if the internal pressure of the nip N is concentrated upon the protrusive portion 212. Therefore, it is possible to prevent the fixing device 106 from changing in the position of the pressure peak and pressure distribution of the fixation nip. Therefore, it is possible to keep the fixing device 106 stable in fixing performance, in particular, in terms of image glossiness level. Moreover, it is unnecessary to increase in thickness the nip formation plate 206, which is formed of a metallic substance, and, therefore, it does not need to be a concern that the present invention might increase a fixing device (and, therefore, an image forming apparatus) in the length of startup time.

Here, the use of a fixing device is not limited to the fixation of an unfixed toner image formed on a sheet of recording medium to the sheet. For example, a fixing device is effective as an apparatus for applying heat and pressure to a toner image that has been permanently or temporarily fixed to a sheet of recording medium, in order to adjust the toner image in surface properties, such as increasing the toner image in glossiness (this type of fixing device also is referred to as fixing device).

The application of the present invention is not limited to the fixing device for an image forming apparatus, such as the one in the preceding embodiment that is for forming a monochromatic (black-and-white) image. That is, the present invention is also applicable to an image forming apparatus for forming a full-color image. Further, the present invention is applicable also to a copying machine, a facsimile machine, and a multifunction image forming apparatus that comprises additional devices, equipment, casings, etc. In other words, the present invention is applicable to various image forming apparatuses that are different in usage.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

What is claimed is:

1. A fixing device for fixing an image formed on a recording material, to the recording material, said fixing device comprising:

a cylindrical belt;

a nip plate contacting an inner surface of said cylindrical belt along a longitudinal direction of said cylindrical belt;

a supporting member having a U-shaped cross section, as viewed in the longitudinal direction of said cylindrical belt, and provided in a hollow portion of said cylindrical belt, said supporting member having two end portions defining an opening of a U-shape thereof and supporting said nip plate;

a heater provided in a region enclosed by said supporting member and said nip plate, and configured to radiate radiant light to said nip plate, to heat said nip plate; and a roller cooperative with said nip plate to form a nip between said cylindrical belt and an outer peripheral surface of said roller, wherein the recording material, on which the image is formed, is fed through and heated in the nip to fix the image on the recording material, wherein said nip plate is provided with a projection in a region of the nip and in a region downstream of the nip with respect to a feeding direction of the recording material, the projection projecting toward said roller and extending in the longitudinal direction of said cylindrical belt, wherein said nip plate is provided with a recess on a side opposite from an outside provided with the projection at a position corresponding to that of the projection with respect to the feeding direction of the recording material, the recess extending in the longitudinal direction of said cylindrical belt, wherein at least a part of one of the two end portions of said supporting member overlaps the recess of said nip plate with respect to the feeding direction of the recording material and the longitudinal direction of said cylindrical belt, and wherein, with respect to the feeding direction of the recording material, a peak part of the projection that projects most is within a range of a width of the one end portion of said supporting member.

2. The fixing device according to claim 1, wherein said nip plate has a flat surface portion from which the projection projects.

3. The fixing device according to claim 1, wherein said nip plate is made of a metal, and the projection and the recess are formed by stamping said nip plate.

4. The fixing device according to claim 1, wherein the projection has a width of 200 μm to 1 mm as measured in the feeding direction of the recording material.

5. The fixing device according to claim 1, wherein a part of said roller in a circumferential direction thereof is elastically deformed by the projection of said nip plate.

6. A fixing device for fixing an image, formed on a recording material, to the recording material, said fixing device comprising:

a cylindrical belt;

a nip plate contacting an inner surface of said cylindrical belt;

a supporting member having a U-shaped cross section and provided in a hollow portion of said cylindrical belt, said supporting member having two end portions defining an opening of a U-shape thereof and supporting said nip plate;

a heater provided in a region enclosed by said supporting member and said nip plate, and configured to radiate radiant light to said nip plate, to heat said nip plate; and a roller cooperative with said nip plate to form a nip between said cylindrical belt and an outer peripheral surface of said roller, wherein a recording material, on which the image is formed, is fed through and heated in the nip to fix the image on the recording material, wherein said nip plate is provided with a projection in a region downstream of the nip with respect to a feeding direction of the recording material, the projection projecting toward said roller and extending in a longitudinal direction of said cylindrical belt, wherein said nip plate is provided with a recess on a side opposite from an outside provided with the projection at a position corresponding to that of the projection with respect to the feeding direction of the recording material, the recess extending in the longitudinal direction of said cylindrical belt, wherein a part of said roller in a circumferential direction thereof is elastically deformed by the projection of said nip plate, and wherein at least a part of one of the two end portions of said supporting member overlaps the recess of said nip plate with respect to the feeding direction of the recording material.

7. The fixing device according to claim 1, wherein the at least part of the one of the two end portions of said supporting member is inserted into the recess.

8. The fixing device according to claim 1, further comprising a spacer provided between the recess and the at least part of the one of the two end portions.

9. The fixing device according to claim 1, wherein the projection has a height of 50 μm to 300 μm.

10. The fixing device according to claim 6, wherein said nip plate has a flat surface portion from which the projection projects.

11. The fixing device according to claim 6, wherein said nip plate is made of a metal, and the projection and the recess are formed by stamping said nip plate.

12. The fixing device according to claim 6, wherein the at least part of the one of the two end portions of said supporting member is inserted into the recess.

13. The fixing device according to claim 6, further comprising a spacer provided between the recess and the at least part of the one of the two end portions.

14. The fixing device according to claim 6, wherein the projection has a height of 50 μm to 300 μm.

15. The fixing device according to claim 6, wherein the projection has a width of 200 μm to 1 mm as measured in the feeding direction of the recording material.

* * * * *